US009283428B1

(12) United States Patent
Esrick et al.

(10) Patent No.: US 9,283,428 B1
(45) Date of Patent: Mar. 15, 2016

(54) EXERCISE SYSTEM

(71) Applicants: Steven Esrick, North Palm Beach, FL (US); Michael E. Criden, South Miami, FL (US)

(72) Inventors: Steven Esrick, North Palm Beach, FL (US); Michael E. Criden, South Miami, FL (US)

( * ) Notice: Subject to any disclaimer, the term of this patent is extended or adjusted under 35 U.S.C. 154(b) by 117 days.

(21) Appl. No.: 14/143,683

(22) Filed: Dec. 30, 2013

Related U.S. Application Data

(63) Continuation-in-part of application No. 13/115,555, filed on May 25, 2011, now abandoned.

(60) Provisional application No. 61/348,029, filed on May 25, 2010.

(51) Int. Cl.

| | |
|---|---|
| ***A63B 71/00*** | (2006.01) |
| ***A63B 23/04*** | (2006.01) |
| ***A63B 21/012*** | (2006.01) |
| ***A63B 22/20*** | (2006.01) |

(52) U.S. Cl.
CPC ..... *A63B 23/04* (2013.01); *A63B 21/012* (2013.01); *A63B 22/201* (2013.01)

(58) Field of Classification Search
CPC ..... A63B 21/00007; A63B 21/00018; A63B 21/00025; A63B 21/012; A63B 21/0125; A63B 21/015; A63B 21/018; A63B 22/14; A63B 22/201; A63B 22/203; A63B 22/0061; A63B 23/04; A63B 23/03516; A63B 23/03525; A63B 2022/0025; A63B 2022/206
USPC ..... 482/51, 70, 71, 79, 131, 132, 135–138, 482/142, 145, 146
See application file for complete search history.

(56) References Cited

U.S. PATENT DOCUMENTS

| | | | | | |
|---|---|---|---|---|---|
| 4,960,276 | A * | 10/1990 | Feuer et al. | ..... | 482/70 |
| 4,979,731 | A * | 12/1990 | Hermelin | ..... | 482/70 |
| 5,279,531 | A * | 1/1994 | Jen-Huey | ..... | 482/70 |
| 5,429,567 | A * | 7/1995 | Gerschefske et al. | ..... | 482/70 |
| 5,643,162 | A * | 7/1997 | Landers et al. | ..... | 482/131 |
| 6,302,830 | B1 * | 10/2001 | Stearns | ..... | 482/70 |
| 6,626,802 | B1 * | 9/2003 | Rodgers, Jr. | ..... | 482/51 |
| 7,163,492 | B1 * | 1/2007 | Sotiriades | ..... | 482/51 |
| 8,425,437 | B2 * | 4/2013 | Zaborowski | ..... | 601/33 |
| 2005/0054492 | A1 * | 3/2005 | Neff | ..... | 482/57 |
| 2005/0079956 | A1 * | 4/2005 | Bruno | ..... | 482/51 |
| 2011/0294633 | A1 * | 12/2011 | Esrick et al. | ..... | 482/139 |

* cited by examiner

*Primary Examiner* — Loan H Thanh
*Assistant Examiner* — Gregory Winter

(57) ABSTRACT

A housing has an upper cover, a bottom, front and rear faces, and parallel left and right side faces. The height of the rear and side faces between their top edge and bottom edge is less that the height of the front face between its top edge and bottom edge. Laterally spaced parallel guiding slots are formed in the upper cover. A pedal mount extends through each of the guiding slots and is attached to an associated left or right pedal. A glide rail beneath each guiding slot has an upwardly facing recess slidably receiving a lower extent of one of the pedal mounts. A motion imparter includes corner pulleys. A cable in a closed loop configuration is trained around the corner pulleys and is attached to the lower extents of the pedal mounts to move the foot pedals in equal and opposite directions during use.

4 Claims, 6 Drawing Sheets

FIG. 1
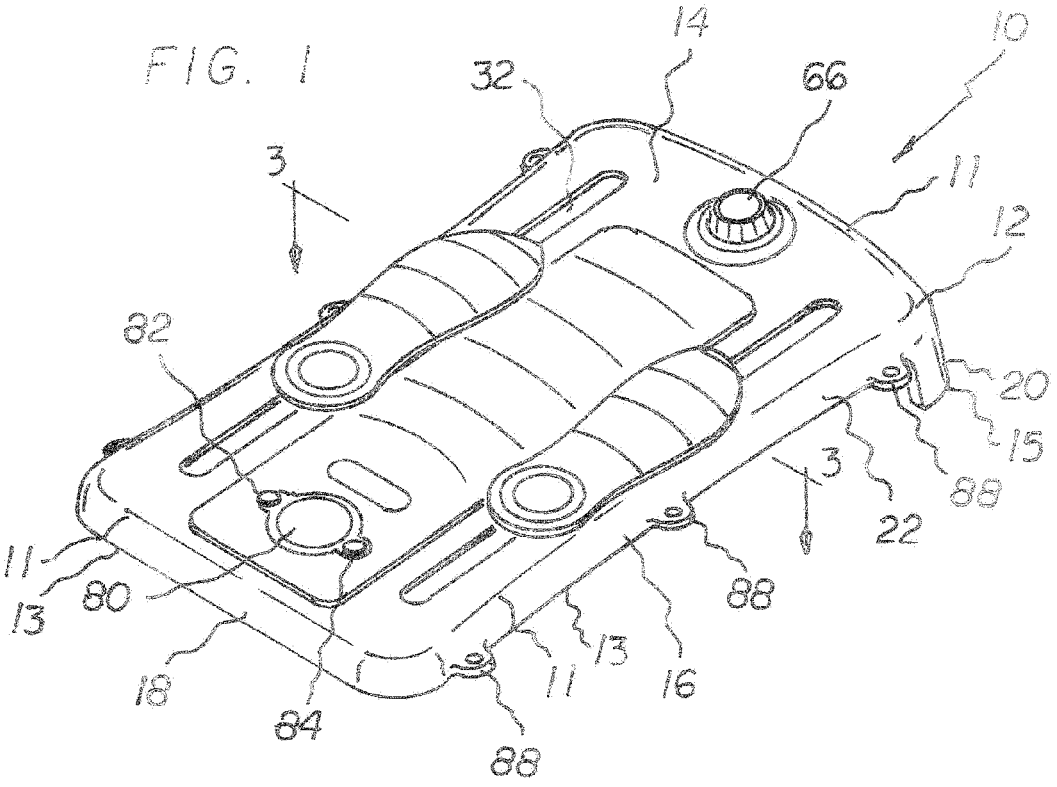
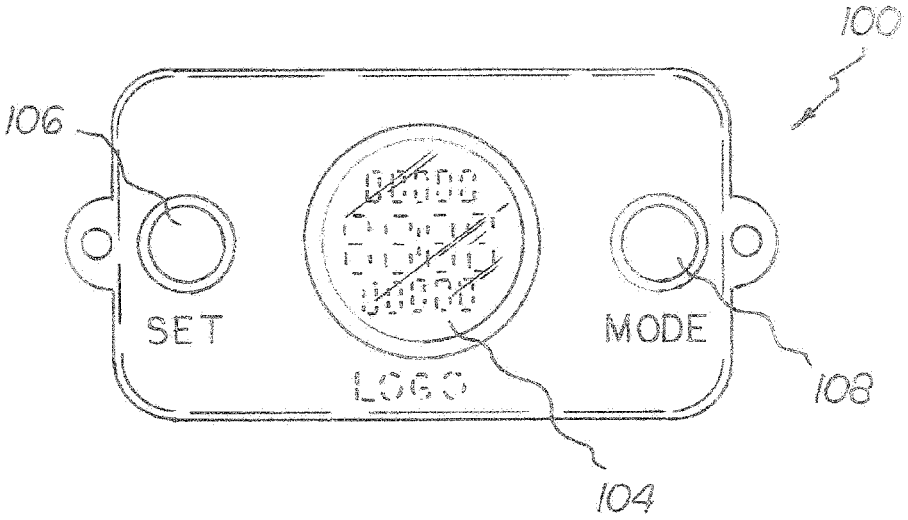
FIG. 2

FIG. 3
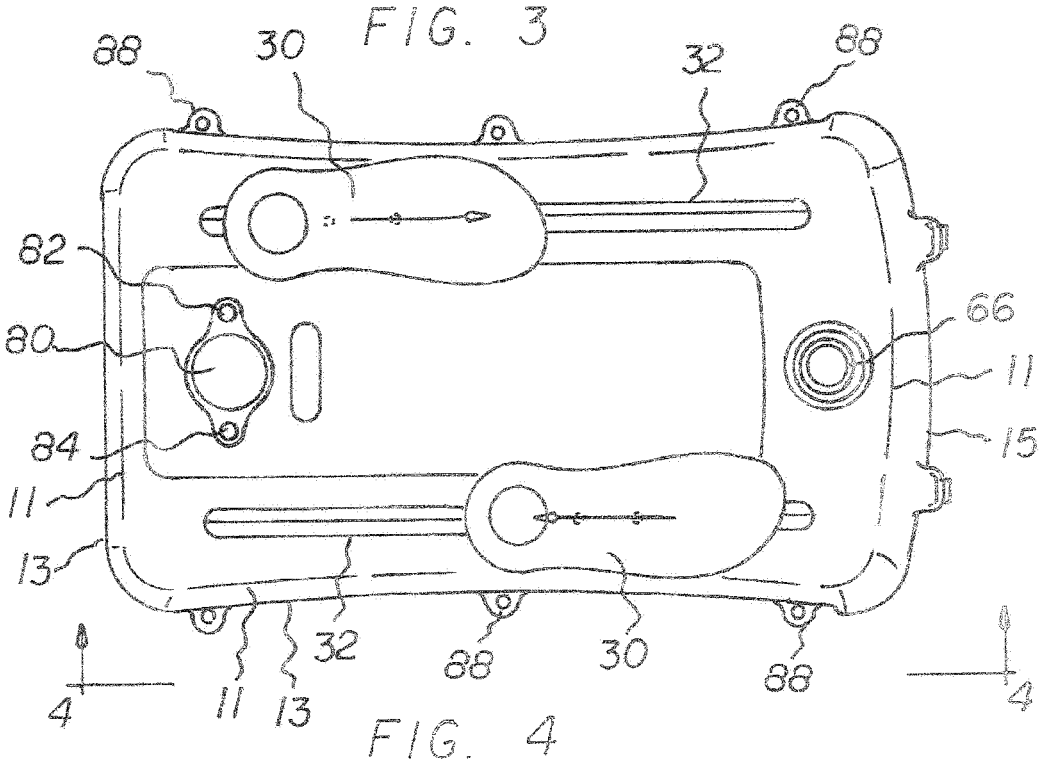
FIG. 4
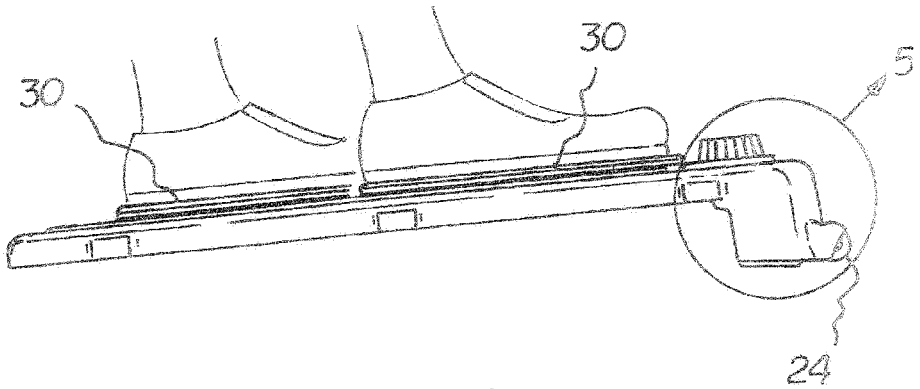
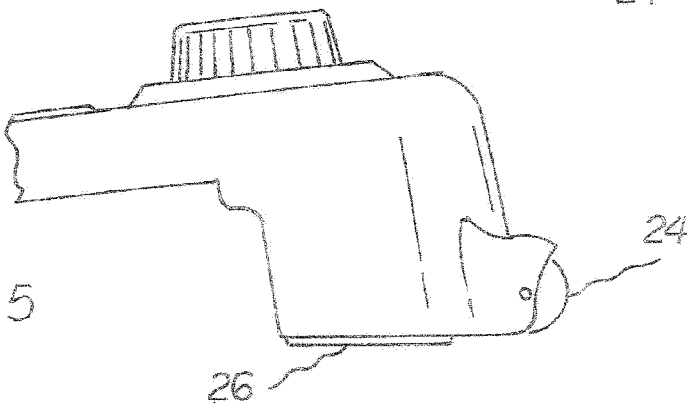
FIG. 5

FIG. 6
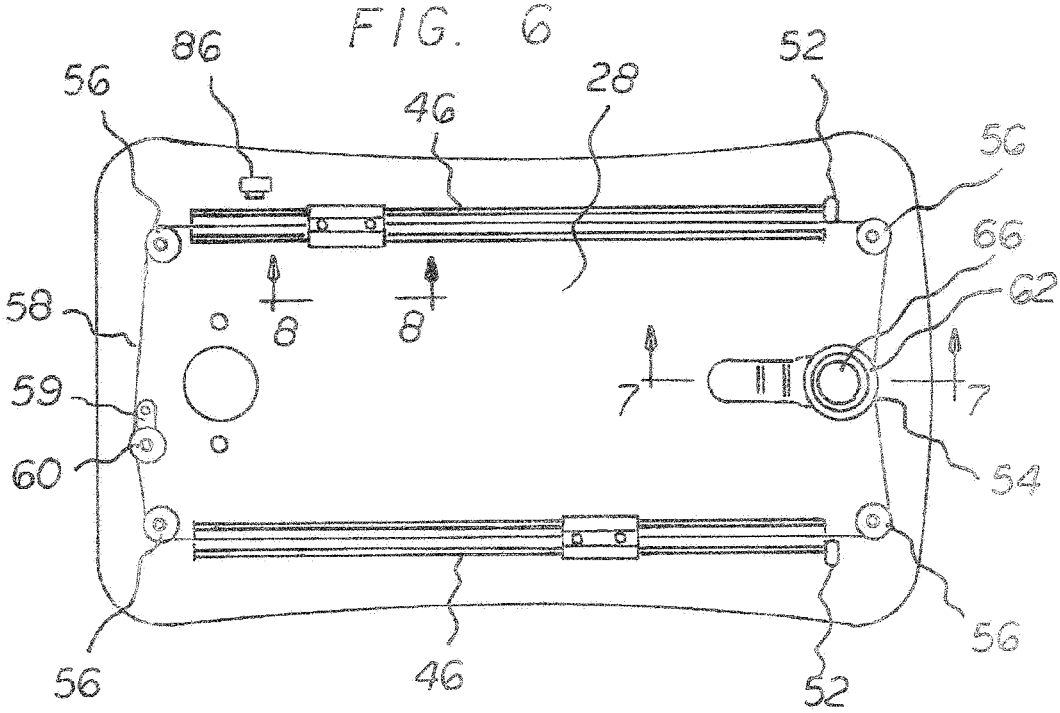
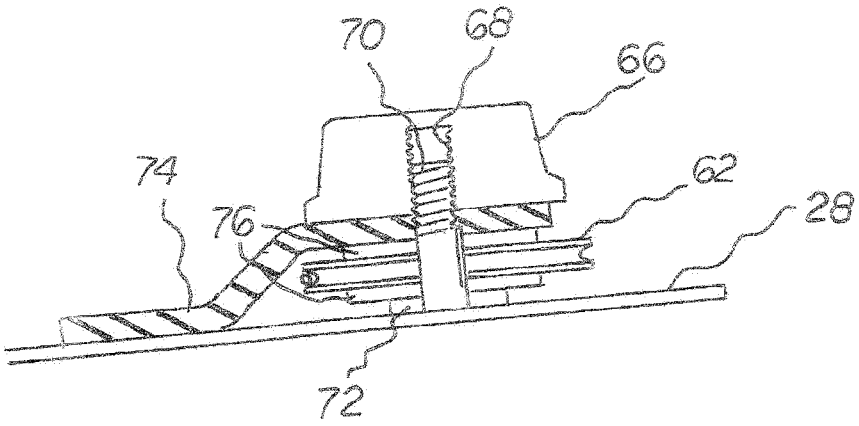
FIG. 7

FIG. 8
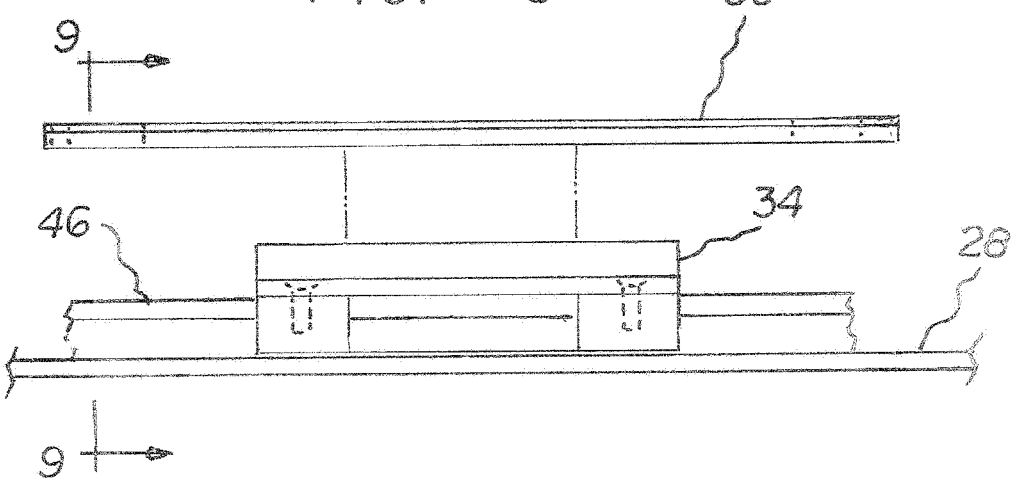
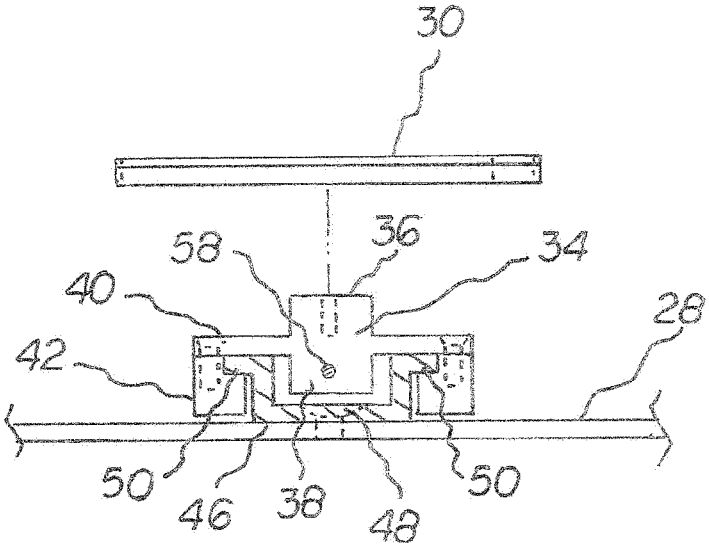
FIG. 9

EXERCISE SYSTEM

RELATED APPLICATION

The present application is a continuation-in-part of pending application Ser. No. 13/115,555 filed May 25, 2011, the subject matter of which is incorporated herein by reference.

BACKGROUND OF THE INVENTION

1. Field of the Invention

The present invention relates to an exercise system and more particularly pertains to positioning the exercise system in a discrete location, as beneath a work desk, for exercising in an unobtrusive manner while sitting to increase healthful cardio-vascular activity of a user. The positioning and exercising and increasing of cardio-vascular activity is done in a safe, convenient and economical manner.

2. Description of the Prior Art

The use of exercise systems and known design and configurations is known in the prior art. More specifically, exercise systems and known design and configurations previously devised and utilized for placement in a discrete location and providing exercise in an unobtrusive manner are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe an exercise system that allows positioning an exercise system in a discrete location, as beneath a work desk, for exercising in an unobtrusive manner while sitting to increase healthful cardio-vascular activity of a user.

In this respect, the exercise system according to the present invention substantially departs from the conventional concepts and designs of the prior art, and in doing so provides an apparatus primarily developed for the purpose of positioning an exercise system in a discrete location, as beneath a work desk, for exercising in an unobtrusive manner while sitting to increase healthful cardio-vascular activity of a user.

Therefore, it can be appreciated that there exists a continuing need for a new and improved exercise system which can be used for positioning the exercise system in a discrete location, as beneath a work desk, for exercising in an unobtrusive manner while sitting to increase healthful cardio-vascular activity of a user. In this regard, the present invention substantially fulfills this need.

SUMMARY OF THE INVENTION

In view of the disadvantages inherent in the known types of exercise systems of known designs and configurations now present in the prior art, the present invention provides an improved exercise system. As such, the general purpose of the present invention, which will be described subsequently in greater detail, is to provide a new and improved exercise system and method which has all the advantages of the prior art and none of the disadvantages.

To attain this, the present invention essentially comprises a housing having an upper cover, a bottom, front and rear faces, and parallel left and right side faces. The height of the rear and side faces between their top edge and bottom edge is less that the height of the front face between its top edge and bottom edge. Laterally spaced parallel guiding slots are formed in the upper cover. A pedal mount extends through each of the guiding slots and is attached to an associated left or right pedal. A glide rail beneath each guiding slot has an upwardly facing recess slidably receiving a lower extent of one of the pedal mounts. A motion imparter includes corner pulleys. A cable in a closed loop configuration is trained around the corner pulleys and is attached to the lower extents of the pedal mounts to move the foot pedals in equal and opposite directions during use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved exercise system which has all of the advantages of the prior art exercise systems and known design and configurations and none of the disadvantages.

It is another object of the present invention to provide a new and improved exercise system which may be easily and efficiently manufactured and marketed.

It is further object of the present invention to provide a new and improved exercise system which is of durable and reliable constructions.

An even further object of the present invention is to provide a new and improved exercise system which is susceptible of a low cost of manufacture with regard to both materials and labor, and which accordingly is then susceptible of low prices of sale to the consuming public, thereby making such exercise system economically available to the buying public.

Lastly, another object of the present invention is to provide an exercise system positionable in a discrete location, as beneath a work desk, for exercising in an unobtrusive manner while sitting to increase healthful cardio-vascular activity of a user.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of an exercise system constructed in accordance with the principles of the present invention.

FIG. 2 is a plan view of an optional remote control panel of the system of FIG. 1.

FIG. 3 is a cross sectional view taken along line 3-3 of FIG. 1.

FIG. 4 is a side elevational view taken along line 4-4 of FIG. 3.

FIG. 5 is an enlarged illustration taken at circle 5 of FIG. 4.

FIG. 6 is a plan view of the system shown in the prior Figures but with the upper cover and foot pedals removed.

FIG. 7 is a cross sectional view taken along lines 7-7 of FIG. 6.

FIG. 8 is an exploded cross sectional views taken along line 8-8 of FIG. 6.

FIG. 9 is an exploded cross sectional view taken along line 9-9 of FIG. 8.

The same reference numerals refer to the same parts throughout the various Figures.

DESCRIPTION OF THE PREFERRED EMBODIMENT

Figure 10:
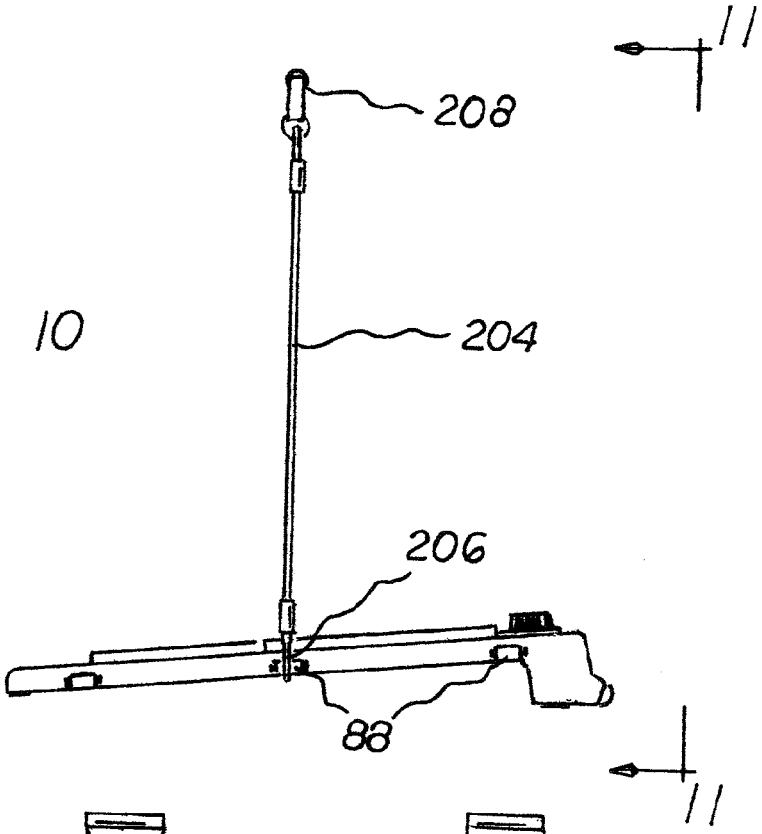
FIG. 10 is a side elevational view of an optional embodiment of the invention.

With reference now to the drawings, and in particular to FIG. 1 thereof, the preferred embodiment of the new and improved exercise system embodying the principles and concepts of the present invention and generally designated by the reference numeral 10 will be described.

The present invention, the exercise system 10 is comprised of a plurality of components. Such components in their broadest context include a housing, left and right foot pedals, glide rails, and a motion imparter. Such components are individually configured and correlated with respect to each other so as to attain the desired objective.

The exercise system 10 of the present invention is positionable in a discrete location, as beneath a work desk, for exercising in an unobtrusive manner while sitting to increase healthful cardio-vascular activity of a user. The positioning and exercising and increasing of cardio-vascular activity are done in a safe, convenient and economical manner.

First provided is a housing 12. The housing has a generally rectilineal configuration with a closed upper cover 14 and an open bottom 16 defining a chamber there between. The housing has a rear face 18 and a parallel front face 20 and parallel left and right side faces 22. Each of the faces has a top edge 11. The side faces and the rear face has a bottom edge 13. The front face has a second bottom edge 15. Two wheels 24 depend from the front face to facilitate intended moving of the system. An elastomeric pad 26 is secured beneath the front face to abate unintended movement of the system. A lower main plate 28 is removably positioned to cover the open bottom. The rear face and the side faces have a common first height between the top edge and the bottom edge. The front face has a second height between the top edge and the second bottom edge between 2½ and 3½ times the first height. The housing is positionable upon a horizontal floor with the upper cover at an angle of between 3 and 7 degrees with respect to the floor.

Two foot pedals 30 are provided. The foot pedals include a left foot pedal and a right foot pedal. The pedals are fabricated of a rigid material, preferably metal, with an elastomeric upper surface to abate slipping. Two laterally spaced parallel guiding slots 32 are formed in the upper cover parallel with the left side face and the right side face. Two pedal mounts 34 are provided. Each pedal mount has an upper extent 36 extending through an associated guiding slot and attached to an associated one of the foot pedals. Each pedal mount has a lower extent 38. Each pedal mount has laterally extending side extents 40 with L-shaped ends 42.

Two glide rails 46 are next provided. Each glide rail is attached to the lower main plate beneath an associated one of the guiding slots. Each glide rail has an upwardly facing recess 48 slidably receiving an associated lower extent of one of the pedal mounts. Each glide rail has outward extensions 50 between the side extents and L-shaped ends. Bumpers 52 are attached to the lower main plate at the ends of the glide rails to limit the movement of the pedal mounts.

Next provided is a motion imparter 54. The motion imparter includes four corner pulleys 56 rotatably attached to and extending upwardly from the lower main plate. The motion imparter also includes a cable 58 in a closed loop configuration trained around the four corner pulleys and fixedly secured to the lower extents of the pedal mounts. The cable is adapted to move the foot pedals in equal and opposite directions during use. A spring urged idler arm 59 is coupled to the lower main plate adjacent to the rear face with a cable tensioning pulley 60 adjacent to the lower plate receiving the cable. An adjusting pulley 62 is coupled to the lower main plate adjacent to the front face receiving the cable.

Next, a tension adjuster is provided. The tension adjuster includes a tension dial 66 with a threaded interior 68 The tension dial is rotatable with respect to the upper cover. A pin 70 has a threaded upper end extending through the upper cover and received within the threaded interior for axial movement of the pin in response to rotation of the tension dial. The pin has a lower end with an attached disk 72 fixedly secured to the lower main plate. A tension pad 74 couples the tension dial and the pin to the lower main plate. Two elastomeric friction disks 76 are provided between the tension pad and the attached disk with the adjusting pulley between the friction disks. In this manner, rotation of the tension dial in opposite directions will vary the height of the adjusting pulley and thereby increase and decrease the pressure needed for reciprocating the foot pedals.

An electronics package is next provided. The electronics package includes a liquid crystal display and printed circuit board mounted to the upper cover adjacent to the lower plate. The electronics package includes a screen 80, an associated set button 82, and an associated mode button 84. The mode button is adapted to allow the user to select the nature of an exercise. The set button is adapted to allow the user to select the extent of the selected exercise. The screen is adapted to display the selected exercise and the extent of the selected exercise.

The system is preferably used with a desk 90 with leg space there beneath. The leg space has a space height between 25 inches and 29 inches. The system having a maximum system height adjacent to the front face between 5 and 8 inches. The maximum system height is between 20 percent and 30 percent of the space height.

The present invention is a full body workout system which may be used while sitting at a desk working. It was designed and redesigned so that the knees of a user do not hit one's desk while getting a cardiovascular workout at one's desk while working. There are a plurality of elliptical products on the market but the primary difference between the present invention and known prior art devices is that the present invention may be used while working at one's desk or cubical, whether at home or in the office. It is also designed so that the user may get a full body workout from a wheel chair. The chair rolls right up to the present invention and someone in rehab or an older person can get a non-weight bearing cardiovascular workout as well as use the bungee cords to get a full body workout without ever having to stand up.

An optional remote electronics package 100 is provided. Note FIG. 2. The optional remote electronics package includes a liquid crystal display and printed circuit board. The optional remote electronics package also includes a screen 104, an associated set button 106, and an associated mode button 108. The mode button is adapted to allow the user to select the nature of an exercise. The set button is adapted to allow the user to select the extent of the selected exercise. The screen is adapted to display the selected exercise and the extent of the selected exercise. A sensor 86 adjacent to a glide rail detects motion of a pedal mount and wirelessly transmits such detected motion for display.

Figure 11:
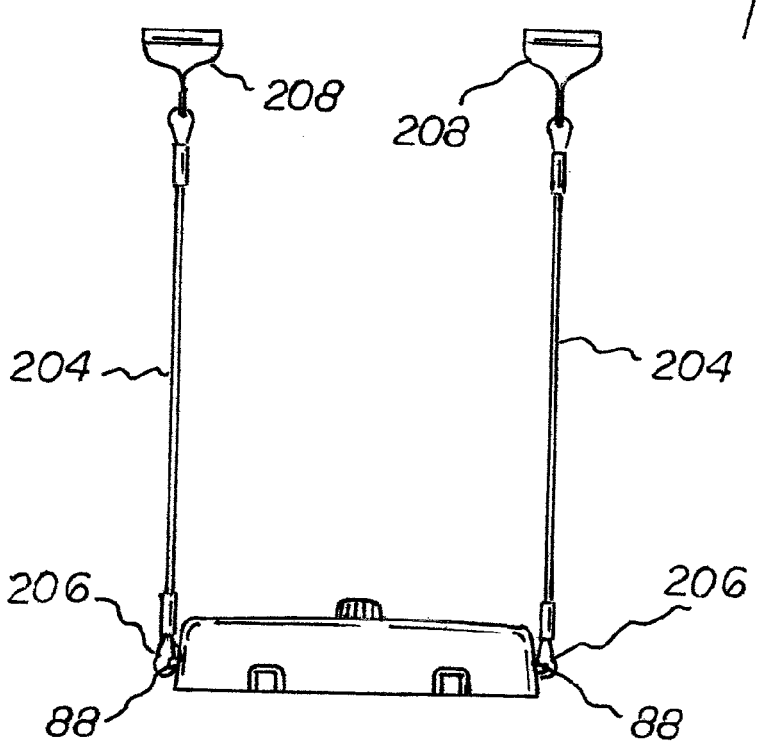
FIG. 11 is a front elevational view taken along line 11-11 of FIG. 10.
Figure 12:
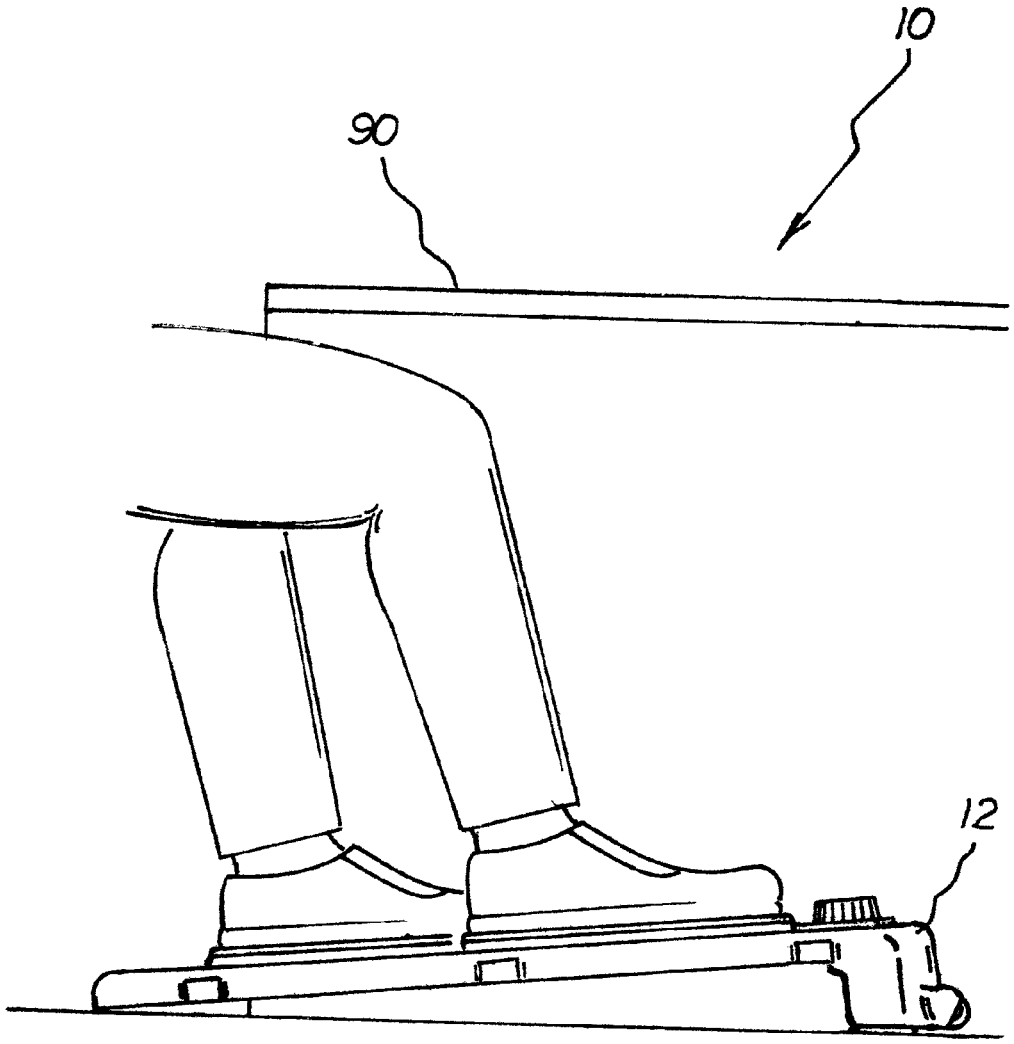
FIG. 12 is a side elevational view similar to FIG. 4 but showing the system in use beneath a desk.

Lastly, optional exercise components are provided. Note FIGS. 10 and 11. The optional exercise components include a plurality of eyelets 88 secured to the side faces at longitudinally spaced locations. The optional exercise components also include two elastic ropes 204. Each elastic rope has a lower end with a clip 206 adapted to couple to a preselected eyelet. Each elastic rope has an upper end with a handle 208 adapted to be grasped and pulled intermittently by the user during exercise.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exercise system comprising:

a housing having an upper cover, an open bottom, front and rear faces, and left and right side faces, the rear and side faces each having a top edge and a bottom edge and a first height between the top and bottom edges, the front face having a top edge and a second bottom edge and a second height between the top and edge and the second bottom edge greater than the first height;

a left foot pedal and a right foot pedal, laterally spaced parallel guiding slots formed in the upper cover, a pedal mount extending through each guiding slot and attached to an associated foot pedal, each pedal mount having a lower extent;

a glide rail beneath an associated guiding slot, each glide rail having an upwardly facing recess slidably receiving an associated lower extent;

a motion imparter including corner pulleys, a cable in a closed loop configuration trained around the corner pulleys and attached to the lower extents of the pedal mounts to move the foot pedals in equal and opposite directions during use; and a lower main plate removably coupled to the open bottom of the housing, an adjusting pulley coupled to the lower main plate adjacent to the front face receiving the cable, a tension adjuster including a tension dial with a threaded interior extending through the upper cover and rotatable with respect to the upper cover, a pin having a threaded upper end received within the threaded interior for axial movement of the pin in response to rotation of the tension dial, the pin having a lower end with an attached disk, a tension pad coupling the tension dial and the pin to the upper cover, two elastomeric friction disks between the tension pad and the attached disk with the adjusting pulley between the friction disks whereby rotation of the tension dial in opposite directions will vary the height of the adjusting pulley and thereby increase and decrease the pressure needed for reciprocating the foot pedals.

2. An exercise system comprising:

a housing having a generally rectilineal configuration with a closed upper cover and an open bottom defining a chamber there between, the housing having a rear face and a parallel front face and parallel left and right side faces, each of the faces having a top edge, the rear and side faces having a bottom edge, the front face having a second bottom edge, two wheels depending from the front face to facilitate intended moving of the system, an elastomeric pad secured beneath the front face to abate unintended movement of the system, a lower main plate removably positioned to cover the open bottom, the rear face and the side faces having a common first height between the top edge and the bottom edge, the front face having a second height between the top edge and the second bottom edge that is between 2.5 and 3.5 times greater than the first height, the housing being positionable upon a horizontal floor with the upper cover at an angle of between 3 and 7 degrees with respect to the floor;

two foot pedals including a left foot pedal and a right foot pedal, the pedals being fabricated of a rigid material with an elastomeric upper surface to abate slipping during use, two laterally spaced parallel guiding slots formed in the upper cover parallel with the left side face and the right side face, two pedal mounts, each pedal mount having an upper extent extending through an associated guiding slot and attached to an associated foot pedal, each pedal mount having a lower extent, each pedal mount having laterally extending side extents with L-shaped ends;

two glide rails, each glide rail attached to the lower main plate beneath an associated guiding slot, each glide rail having an upwardly facing recess slidably receiving an associated lower extent, each glide rail having outward extensions between the side extents and L-shaped ends, bumpers attached to the lower main plate to limit the movement of the pedal mounts;

a motion imparter including four corner pulleys rotatably attached to and extending upwardly from the lower main plate, the motion imparter also including a cable in a closed loop configuration trained around the four corner pulleys and fixedly secured to the lower extents of the pedal mounts, the cable adapted to move the foot pedals in equal and opposite directions during use, a spring urged idler arm coupled to the lower main plate adjacent to the rear face with a cable tensioning pulley adjacent to the lower main plate receiving the cable, an adjusting pulley coupled to the lower main plate adjacent to the front face receiving the cable;

a tension adjuster including a tension dial with a threaded interior and rotatable with respect to the upper cover, a pin having a threaded upper end extending through the upper cover and received within the threaded interior for axial movement of the pin in response to rotation of the tension dial, the pin having a lower end with an attached disk fixedly secured to the lower main plate, a tension pad coupling the tension dial and the pin to the lower main plate, two elastomeric friction disks between the tension pad and the attached disk with the adjusting pulley between the friction disks whereby rotation of the tension dial in opposite directions will vary the height of the adjusting pulley and thereby increase and decrease the pressure needed for reciprocating the foot pedals; and an electronics package including a liquid crystal display and printed circuit board mounted to the upper cover adjacent to the lower plate, the electronics package including a screen and an associated set button and an associated mode button, the mode button adapted to allow the user to select the nature of an exercise, the set button adapted to allow the user to select the extent of the selected exercise, the screen adapted to display the selected exercise and the extent of the selected exercise, a sensor attached to the lower main plate adjacent to one of the glide rails to detect motion of one of the pedal mounts and to wirelessly transmit such detected motion for display.

3. The system as set forth in claim 2 and further including a remote electronics package including a liquid crystal display and printed circuit board, the remote electronics package including a screen and an associated set button and an associated mode button, the mode button adapted to allow the user to select the nature of an exercise, the set button adapted to allow the user to select the extent of the selected exercise, the screen adapted to display the selected exercise and the extent of the selected exercise.

4. The system as set forth in claim 2 and further including exercise components including a plurality of eyelets secured to the side faces at longitudinally spaced locations, the exercise components also including two elastic ropes, each elastic rope having a lower end with a clip adapted to couple to a preselected one of the eyelets, each elastic rope having an upper end with a handle adapted to be grasped and pulled intermittently by the user during exercise.

* * * * *